US008757296B2

(12) United States Patent
Beckstead et al.

(10) Patent No.: US 8,757,296 B2
(45) Date of Patent: Jun. 24, 2014

(54) METHODS, SYSTEMS, AND APPARATUS FOR PROCESSING DRILL TOOLS

(75) Inventors: Gary Beckstead, Woodland, UT (US); Troy Beckstead, Saratoga Springs, UT (US)

(73) Assignee: Rite Way Technologies, LLC, Vernal, UT (US)

( * ) Notice: Subject to any disclaimer, the term of this patent is extended or adjusted under 35 U.S.C. 154(b) by 792 days.

(21) Appl. No.: 12/874,074

(22) Filed: Sep. 1, 2010

(65) Prior Publication Data

US 2011/0209539 A1 Sep. 1, 2011

Related U.S. Application Data

(60) Provisional application No. 61/238,952, filed on Sep. 1, 2009.

(51) Int. Cl.
*E21B 10/00* (2006.01)

(52) U.S. Cl.
USPC ..... 175/327

(58) Field of Classification Search
USPC ..... 175/327; 73/152.01
See application file for complete search history.

(56) References Cited

U.S. PATENT DOCUMENTS

| | | | | |
|---|---|---|---|---|
| 4,529,341 | A * | 7/1985 | Greene | 408/212 |
| 2007/0106487 | A1* | 5/2007 | Gavia et al. | 703/7 |
| 2010/0206641 | A1* | 8/2010 | Hall et al. | 175/426 |
| 2010/0282026 | A1* | 11/2010 | Luce et al. | 76/108.1 |

* cited by examiner

*Primary Examiner* — Brad Harcourt
(74) *Attorney, Agent, or Firm* — ALG Intellectual Property, LLC

(57) ABSTRACT

An exemplary method for optimizing drilling performance of a rotary drill tool is disclosed. According to the method, a rotary drill tool may be secured to an orienting member and a cutting element rotational axis of the rotary drill tool may be identified. Radial locations of a plurality of surface regions of the rotary drill tool may be measured relative to the cutting element rotational axis. At least one selected surface region from the plurality of measured surface regions may be modified such that the at least one selected surface region is located at a selected radial distance relative to the cutting element rotational axis. An exemplary method for grinding a down-hole drill tool is also disclosed. According to the method, a down-hole drill tool may be secured to a holding member in a substantially vertical orientation and portions of the down-hole drill tool may be ground using a grinding wheel.

16 Claims, 3 Drawing Sheets

METHODS, SYSTEMS, AND APPARATUS FOR PROCESSING DRILL TOOLS

BACKGROUND

Rotary tools employing wear-resistant cutters are conventionally utilized in a variety of drilling, cutting, and machining operations. For example, superabrasive and/or superhard materials, such as polycrystalline diamond ("PCD") or ceramics (e.g., cubic boron nitride, silicon carbide, and the like), are often used in drilling tools, machining equipment, and in other mechanical systems. Cutting elements are often employed on earth boring rotary drill bits, such as roller cone drill bits and fixed-cutter drill bits used for drilling subterranean formations. A rotary drill bit may include one or more cutting elements affixed to a bit body of the rotary drill bit.

Conventional earth boring drill bits may include a bit body formed from steel or a hard matrix material, such as tungsten carbide. Cutting elements are typically positioned along leading edges or surfaces of the bit body so that the cutting elements engage and drill earth formations as the bit body is rotated in its intended direction of use. The cutting elements may be positioned and secured in recesses formed in an exterior of the bit body. Depending on the bit body design, cutting elements may either be positioned in a mold prior to formation of the bit body or secured to the bit body following fabrication.

A steel bit body is often machined from round steel stock to a desired shape. Various surface features, such as blades and/or junk slots, and internal features, such as fluid passages for delivery of drilling fluid, may be machined into the bit body using a machine tool. An end of the bit body may then be welded and/or otherwise secured to a shank, such as a threaded steel shank. During use in drilling operations, the shank may secure the drill bit to a corresponding connection point, such as a threaded connection on a drill string.

A bit body formed from a hard matrix material is generally formed by packing a graphite mold with tungsten carbide powder, and subsequently infiltrating the powder with a molten copper alloy binder, such as brass. A drill bit "blank" comprising steel or other suitable material may be positioned in the mold so that the blank becomes securely fixed to the matrix upon cooling. The blank may be generally cylindrical or may include various surface features, such as blades and/or junk slots. A mandrel may also be positioned in the mold and subsequently removed after molding and furnacing, leaving behind fluid passages in the drill bit for conveyance of drilling fluid to the cutting surfaces. After the bit body has been molded, the end of the steel blank may be secured to a threaded shank.

During production of drill bits, numerous factors may result in imperfections in the external shape of the drill bit leading to inconsistent and/or sub-optimal performance of the drill bit during drilling. In molding processes, even slight changes in processing conditions may result in significant alterations in the shape and performance of the finished product. For example, during molding operations, various conditions, such as humidity, processing temperatures, and/or rates of heating and/or cooling may result in different rates of expansion and/or shrinkage of a molded bit body during processing of the molded part. The compositions of materials used in the molding process may also affect the finished part.

Removal of material during drilling is performed by the cutting elements located radially around the bit body. In conventional drill bits, the cutting elements may be positioned strategically to establish the maximum performance in removing material during downhole drilling. The orientation of the cutting elements may establish a cutting element rotational axis that differs from the bit body rotational axis due to various imperfections in the drill bit, such as manufacturing imperfections as mentioned above. The cutting element rotational axis may be determined by the final placement of the cutting elements relative to one another, their placement on the bit body, and locations of surfaces regions of the cutting elements relative to one another and the bit body.

Additionally, during drilling operations, the bit body and cutting elements may be exposed to significant abrasive and erosive forces, causing changes in the exterior shape of the drill bit. As the drill bit experiences wear, the performance of the drill bit tends to decrease. Cutting elements on the drill bits are typically subjected to the greatest amount of wear during drilling. Accordingly, the cutting elements may need to be replaced long before the bit body. Conventionally, worn cutting elements are removed from the bit body and replaced by new cutting elements, which are secured to the old bit body.

Subsequently, the new cutting elements may be machined so that they extend to a desired distance relative to the bit body. For example, cutting elements protruding radially outward from the bit body may be ground using a grinding machine so that the drill bit is sized to fit within a borehole having a certain diameter. A grinding machine conventionally used for grinding cutting elements mounted on a drill bit requires the drill bit to be manually loaded in the grinding machine so that the drill bit extends in a substantially horizontal direction. A grinding wheel that is rotated about a generally horizontal axis is then used to grind the cutting elements to specified depths to ultimately achieve the desired diameter of the outer bit cutting elements relative to the bit body.

Following manufacturing of new drill bits or machining of used drill bits, conventional measurement tools may be used to determine whether certain characteristics of the drill bits are within specified tolerances. However, such measurement tools are often incapable of determining various characteristics affecting the performance of the drill bits during operation. For example, gauge rings are conventionally utilized to determine whether the outer diameter of a drill bit lies within a specified range, ensuring that the drill bit is sized to fit within a borehole having a specified diameter. While the gauge rings can determine the general diameter of the drill bit, they typically cannot be used to accurately determine a rotational axis of the drill bit body or the rotational axis of the cutting elements.

A drill bit having an outer diameter that is not centered about the cutting element rotational axis or the bit body rotational axis may perform in an inconsistent or undesirable manner during drilling. Drill bits not operating around the cutting element rotational axis will seek and track the cutting element rotational axis regardless of the bit body rotational axis. For example, if a drill bit is not sufficiently centered about the cutting element rotational axis, there may be significant skipping or rifling of the drill bit in the borehole as the drill bit seeks the cutting element rotational axis. Even small differences in the shape or alignment of a drill bit may significantly affect the performance of the bit. Sub-optimal performance of drill tools, such as drill bits, may cause decreased performance efficiency during drilling operations, premature damage to bit bodies and cutting elements, and lost costs and labor productivity due to unnecessary repairs and part changes.

SUMMARY

According to various embodiments, tool processing systems, methods, and apparatus may facilitate determination of rotational axes of rotary drill tools and may enable rotary drill tools to be modified so that outer portions of the rotary drill tools are substantially centered about the rotational axes and/or so that the rotary drill tools exhibit specified amounts of eccentricity relative to the rotational axes. Tool processing systems, methods, and apparatus may log and store information related to various characteristics of rotary drill tools. Such stored information may be utilized in calculations for determining rotational axes of various rotary drill tools. Such stored information may also be utilized to determine efficiency and/or performance of various types of grinding wheels, particularly with respect to various types and styles of rotary drill tools.

In various embodiments, such stored information may also be used to provide quality assurance reports concerning dimensions and accuracy of various characteristics of rotary drill tools following manufacturing and/or grinding processes. Additionally, such stored of information may allow down-hole cutting performance of rotary drill tools to be correlated to various dimensions of the rotary drill tools. In some examples, cutting performance of rotary drill tools may be correlated to the accuracy of the tool diameters and/or centricity of the tools about their rotational axes. Such correlations may be determined, for example, by measuring and storing dimensions of rotary drill tools and determining the subsequent performance of the tools.

According to at least one embodiment, a method for optimizing drilling performance of a rotary drill tool may comprise securing a rotary drill tool to an orienting member and identifying a cutting element rotational axis of the rotary drill tool. The method may also comprise measuring radial locations of a plurality of surface regions of the rotary drill tool relative to the cutting element rotational axis. The method may additionally comprise modifying at least one selected surface region from the plurality of measured surface regions such that the at least one selected surface region is located at a selected radial distance relative to the cutting element rotational axis.

According to various embodiments, a method for optimizing drilling performance of a rotary drill tool may comprise securing a rotary drill tool to an orienting member, identifying a cutting element rotational axis of the rotary drill tool, and measuring radial locations of a plurality of surface regions of the rotary drill tool relative to the cutting element rotational axis. The method may additionally comprise measuring one or more performance characteristics of the rotary drill tool and correlating the radial locations of the plurality of surface regions to the performance characteristics of the rotary drill tool.

According to some embodiments, a method for grinding a down-hole drill tool may comprise securing a down-hole drill tool to a holding member in a substantially vertical orientation and grinding portions of the down-hole drill tool using a grinding wheel.

According to at least one embodiment, a method for optimizing grinding machine performance may comprise securing a rotary drill tool to an orienting member, identifying a cutting element rotational axis of the rotary drill tool, and measuring radial locations of a plurality of surface regions of the rotary drill tool relative to the cutting element rotational axis. The method may further comprise grinding at least one selected surface region from the plurality of measured surface regions using a grinding wheel and measuring one or more performance characteristics of the grinding wheel.

According to various embodiments, a method for optimizing drilling performance of a rotary drill tool may comprise securing a rotary drill tool to an orienting member and identifying a rotational axis of the rotary drill tool. The rotational axis may comprise at least one of a cutting element rotational axis and a bit body rotational axis. The method may additionally comprise measuring radial locations of a plurality of surface regions of the rotary drill tool relative to the rotational axis and modifying at least one selected surface region from the plurality of measured surface regions such that the at least one selected surface region is located at a selected radial distance relative to the rotational axis.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
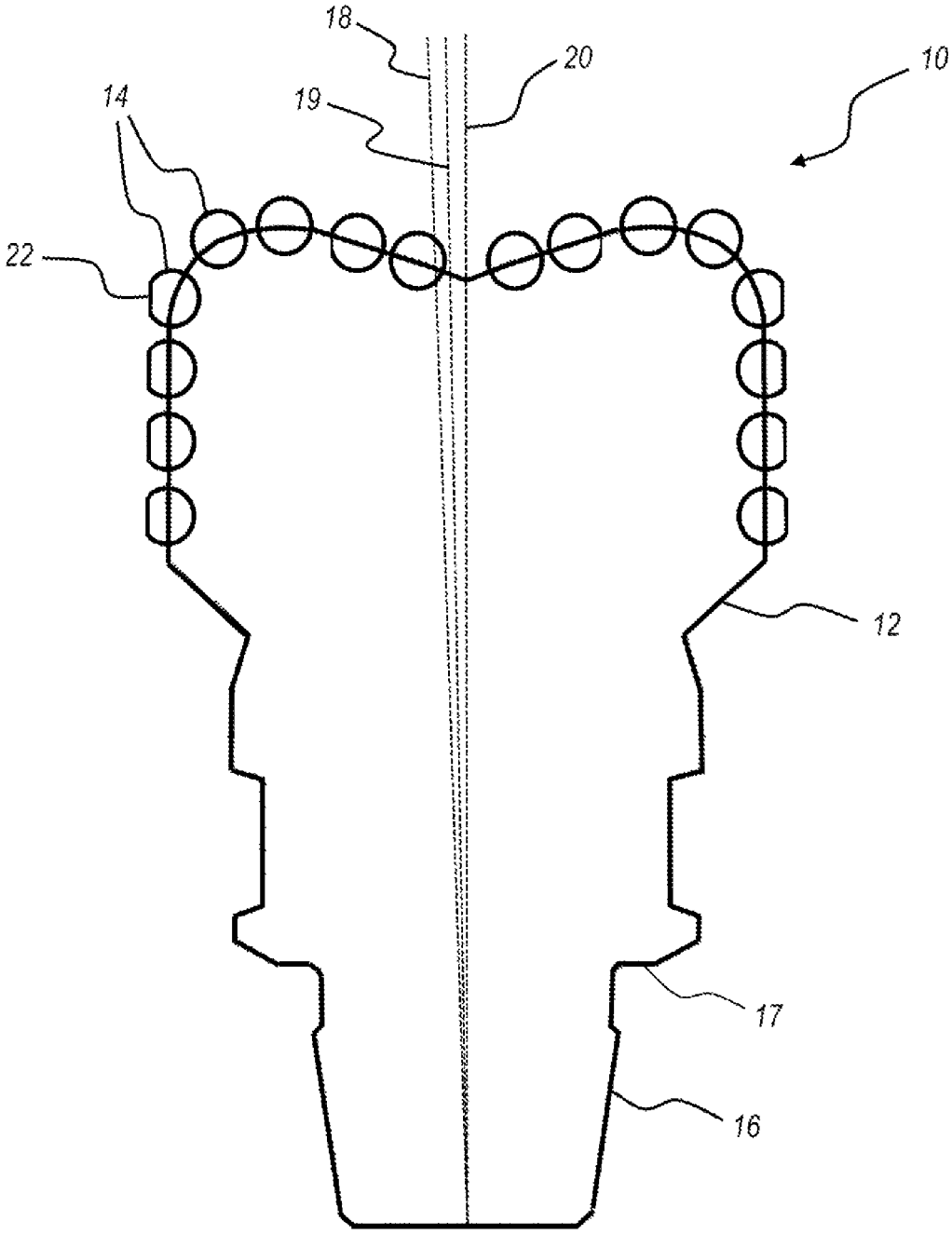
FIG. 1 is cross-sectional side view of a rotary drill bit according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

As used herein, the terms "superabrasive" and "superhard" refer to materials exhibiting a hardness exceeding a hardness of tungsten carbide. For example, a superabrasive article may represent an article of manufacture, at least a portion of which may exhibit a hardness exceeding the hardness of tungsten carbide. As used herein, the term "cutting" refers broadly to machining processes, drilling processes, boring processes, and/or any other material removal process utilizing a drill tool.

FIG. 1 is cross-sectional side view of a drill bit 10 according to at least one embodiment. Drill bit 10 may represent any type or form of rotary drilling tool, including, for example, a rotary drill bit. In at least one embodiment, drill bit 10 may comprise an earth-boring tool configured to drill boreholes in subterranean formations for extraction of petroleum, natural gas, and/or other subterranean materials. Drill bit 10 may comprise a bit body 12 formed of any suitable hard material, such as, for example, steel and/or a matrix material.

As illustrated in FIG. 1, drill bit 10 may also comprise a shank 16, which is coupled to or formed integrally with bit body 12. For example, shank 16 may be readily coupled with and/or welded to bit body 12. Shank 16 may be configured to be coupled with a connection portion of a drill string. For example, shank 16 may comprise a threaded exterior configured to be threadedly coupled to a corresponding threaded portion of the drill string. Drill bit 10 may also comprise a shoulder 17 configured to stably mount and orient drill bit 10 on a corresponding drill string.

Drill bit 10 may also comprise one or more cutting elements 14 mounted to exterior portions of bit body 12. For example, cutting elements 14 may be mounted on leading faces of bit body 12, such as radially outward and/or axially forward portions of bit body 12, as shown in FIG. 1. Cutting elements 14 may be formed of any suitable material, including, for example, PCD, ceramic, and/or other hard or superhard materials. In at least one example, cutting elements 14 may comprise PCD compacts, each comprising a polycrystalline diamond layer bonded to a tungsten carbide substrate. Cutting elements 14 may be secured to bit body 12 using any suitable attachment means, including, without limitation, brazing, welding, and/or interference fitting. In some examples, cutting elements 14 may be secured within recesses defined in exterior portions of bit body 12.

Drill bit 10 may also include any other suitable internal and/or external features, without limitation. In some embodiments, drill bit 10 may include internal passageways for communicating drilling fluid to cutting elements 14 during drilling. In additional embodiments, drill bit 10 may include junk slots, blades, and/or other topographical features defined in exterior portions of drill bit 10. For example, bit body 12 may comprise bit blades extending radially outward from a central portion of bit body 12. Cutting elements 14 may be attached to the bit blades. Junk slots for communicating debris away from cutting faces of drill bit 10 may be defined between adjacent blades. In some examples, drilling fluid may carry cutting debris away from cutting surfaces and leading face portions of drill bit 12 via such junk slots.

According to various embodiments, drill bit 10 may have a bit body rotational axis 18 and a perceptual centerline 20. The bit body rotational axis 18 may represent a generally longitudinal axis about which drill bit 10 is rotated by a drill string that drill bit 10 is coupled to. Perceptual centerline 20, on the other hand, may represent a perceived central centerline or axis extending longitudinally through drill bit 10. In some examples, certain portions of drill bit 10 may be substantially centered about perceptual centerline 20 rather than bit body rotational axis 18.

Figure 2:
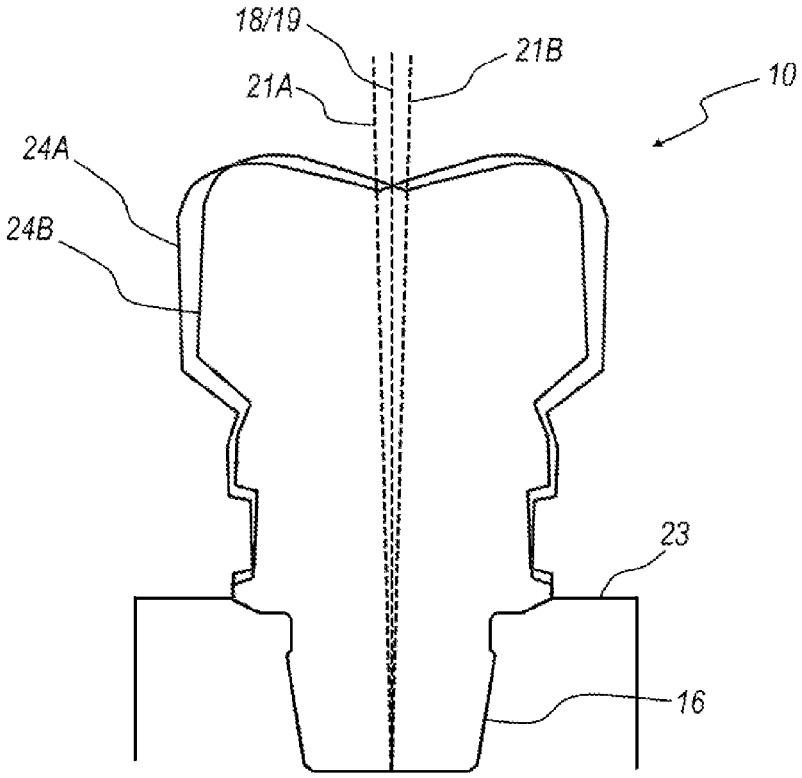
FIG. 2 is a cross-sectional side view of a rotary drill bit mounted on an orienting member according to at least one embodiment.

Additionally cutting elements 14 may form a cutting element rotational axis 19 based upon the orientation of cutting elements 14 and positioning of cutting elements 14 in bit body 12. The cutting element rotational axis 19 may be considered the true cutting centerline or axis of drill bit 10. Cutting element rotational axis 19 may not necessarily be congruent to bit body rotational axis 18, as illustrated in FIG. 2.

According to various embodiments, optimum results of manufacturing and drilling performance may be achieved when cutting element rotational axis 19 and bit body rotational axis 18 are substantially congruent. In at least one embodiment, the most important axis for achieving optimal drilling performance may be the cutting element rotational axis 19, as that is the axis that may be sought by drill bit 10 during downhole drilling operations. As discussed below in relation to FIGS. 2 and 3, cutting element rotational axis 19 and bit body rotational axis 18 may be substantially congruent or have substantially the same rotational center, and accordingly, FIGS. 2 and 3 illustrate a single line (rotational axis 18/19) representing both bit body rotational axis 18 and cutting element rotational axis 19.

Drill bit 10 may be designed so that bit body rotational axis 18, cutting element rotational axis 19, and/or perceptual centerline 20 are substantially congruent. In some embodiments, drill bit 10 may optionally be designed so that bit body rotational axis 18 and/or cutting element rotational axis 19 are offset from perceptual centerline 20 by a known amount, providing drill bit 10 with a suitable degree of eccentricity during certain drilling operations. When bit body rotational axis 18, cutting element rotational axis 19, and/or perceptual centerline 20 are offset from one another by an undesirable amount, drill bit 10 may operate at a sub-optimal or inconsistent performance level.

Bit body rotational axis 18, cutting element rotational axis 19, and/or perceptual centerline 20 may differ from one another due to a variety of factors. Various manufacturing conditions may cause differences between bit body rotational axis 18, cutting element rotational axis 19, and/or perceptual centerline 20. For example, during molding operations, various conditions, such as humidity, compositions of materials, processing temperatures, and/or rates of heating and/or cooling may result in different rates of expansion and/or shrinkage of a molded bit body. Additionally, bit body rotational axis 18, cutting element rotational axis 19, and/or perceptual centerline 20 may grow further apart as drill bit 10 undergoes wear during drilling operations and subsequent maintenance and repair of drill bit 10.

Figure 3:
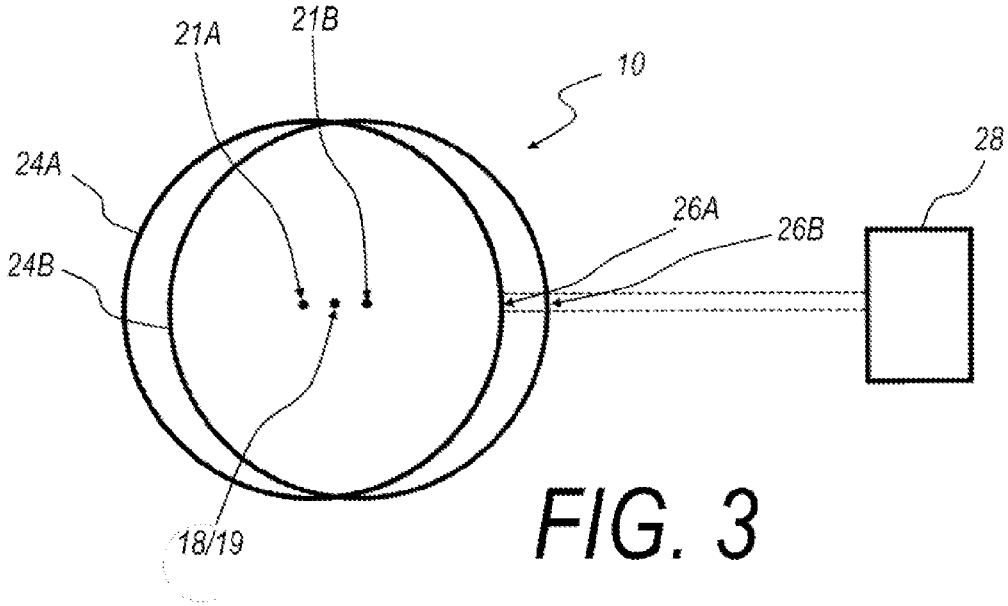
FIG. 3 is a cross-sectional top view of a rotary drill bit and a scanner according to at least one embodiment.

FIG. 2 is a cross-sectional side view of rotary drill bit 10 mounted on an orienting member 23 and FIG. 3 is a cross-sectional top view of rotary drill 10 bit and a scanner 28 according to various embodiments. As illustrated in this figure, cutting element rotational axis 19 and bit body rotational axis 18 may be substantially congruent. Accordingly, FIGS. 2 and 3 illustrate a single line, referred to hereinafter as rotational axis 18/19, representing both bit body rotational axis 18 and cutting element rotational axis 19. Orienting member 23 may comprise any suitable part, such as a collet, configured to hold and/or orient drill bit 10. Orienting member 23 may be configured to orient drill bit 10 in a specified orientation so that rotational axis 18/19 may be determined. Orienting member 23 may have a known orienting or rotational axis such that when the drill bit 10 is mounted on orienting member 23, rotational axis 18/19 of drill bit 10 is substantially congruent to the orienting or rotational axis of orienting member 23. Accordingly, rotational axis 18/19, as illustrated in FIG. 2, may also represent an orienting or rotational axis of orienting member 23.

FIGS. 2 and 3 illustrate two orientations, first orientation 24A and second orientation 24B, of drill bit 10 mounted to orienting member 23. In some examples, as shown in FIG. 2, drill bit 10 may be mounted on orienting member 23 in a substantially vertical orientation. According to at least one example, drill bit 10 may be positioned in a specific orientation with respect to orienting member 23. Additionally, drill bit 10 may have multiple orientations with respect to a measuring device, such as scanner 28, at different radial positions with respect to rotational axis 18/19.

For example, scanner 28 may be located at a specific radial distance and/or location relative to rotational axis 18/19. Orienting member 23 may comprise a rotational member having a rotational axis substantially congruent with rotational axis 18/19 of drill bit 10. When orienting member 23 is positioned in a first radial position respective to rotational axis 18/19, drill bit 10 may be positioned in a first orientation 24A and perceptual centerline 20 may be positioned in a first orientation 21A with respect to scanner 28. Scanner 28 may measure one or more surface locations on drill bit 10, such as first radial location 26A, when drill bit 10 is positioned in first orientation 24A.

Orienting member 23 may then be rotated to a second radial position respective to rotational axis 18/19. At the second radial position, drill bit 10 may be positioned in a second orientation 24B and perceptual centerline 20 may be positioned in a second orientation 21B with respect to scanner 28. Scanner 28 may measure one or more surface locations on drill bit 10, such as second radial location 26B, when drill bit 10 is positioned in second orientation 24B. Orienting member 23 may also be rotated to additional radial positions respective to rotational axis 18/19 and scanner 28 may measure additional surface locations on drill bit 10.

The measurements obtained at various radial locations on drill bit 10 relative to rotational axis 18/19 may be used to determine regions on drill bit 10 that may be modified in order to substantially center exterior portions of drill bit 10 around rotational axis 18/19, thereby improving the concentricity of at least a portion of drill bit 10 with respect to rotational axis 18/19. Alternatively, the measurements may be used to determine regions on drill bit 10 that may be modified to provide drill bit 10 with a desired level of eccentricity relative to rotational axis 18/19.

In additional embodiments, scanner 28 may be configured to move radially around and/or horizontally and/or vertically relative to drill bit 10 and orienting member 23, enabling measurements of exterior portions of drill bit 10 to be obtained at a plurality of scanner locations relative to drill bit 10. In such embodiments, orienting member 23 may comprise a stationary member having an orienting axis. In at least one example, scanner 28 may be configured to move around drill bit 10 in a substantially circular path centered about rotational axis 18/19.

Figure 4:
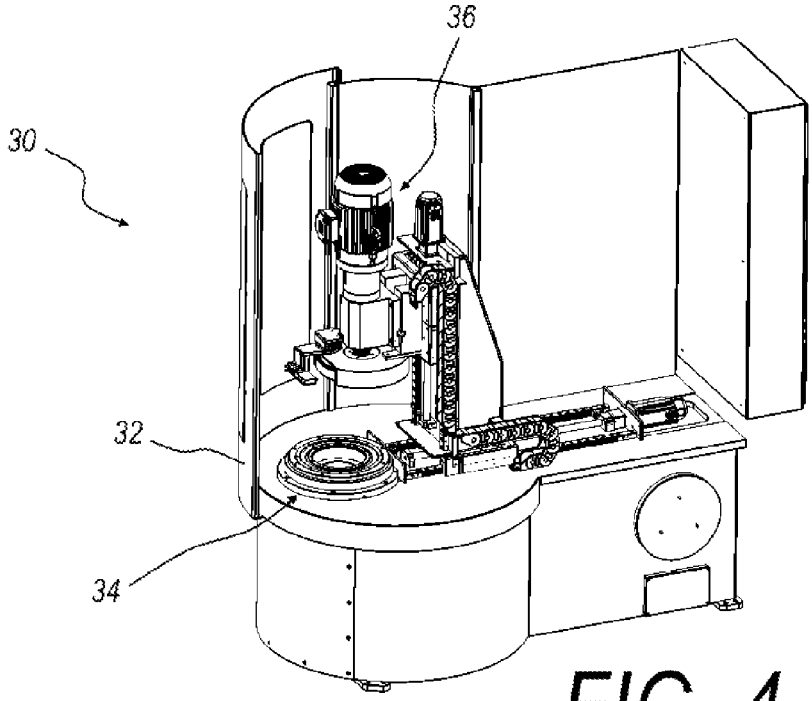
FIG. 4 is a cut-away perspective view of an exemplary apparatus for processing rotary drill tools according to at least one embodiment.

FIG. 4 is a cut-away perspective view of an exemplary tool processing apparatus 30 for processing rotary drill tools according to at least one embodiment. As illustrated in FIG. 4, tool processing apparatus 30 may comprise a housing 32, a rotational orientation portion 34, a horizontal-vertical orientation portion 36, and any other suitable components for processing rotary drill tools, without limitation. According to various embodiments, housing 32 may substantially surround rotational orientation portion 34 and horizontal-vertical orientation portion 36. Housing 32 may be opened for loading and unloading rotary drill tools and/or to perform maintenance, repair, and/or adjustments on tool processing apparatus 30. During processing of rotary drill tools, housing 32 may be closed, enabling relatively safe and clean operation of processing apparatus 30 in a self-contained environment.

Rotational orientation portion 34 may be configured to hold and/or rotate a drilling tool, such as drill bit 10. Horizontal-vertical orientation portion 36 may be configured to position and move a measuring instrument, such as a scanner, and/or a grinding wheel relative to a drilling tool mounted on rotational orientation portion 34.

Figure 5:
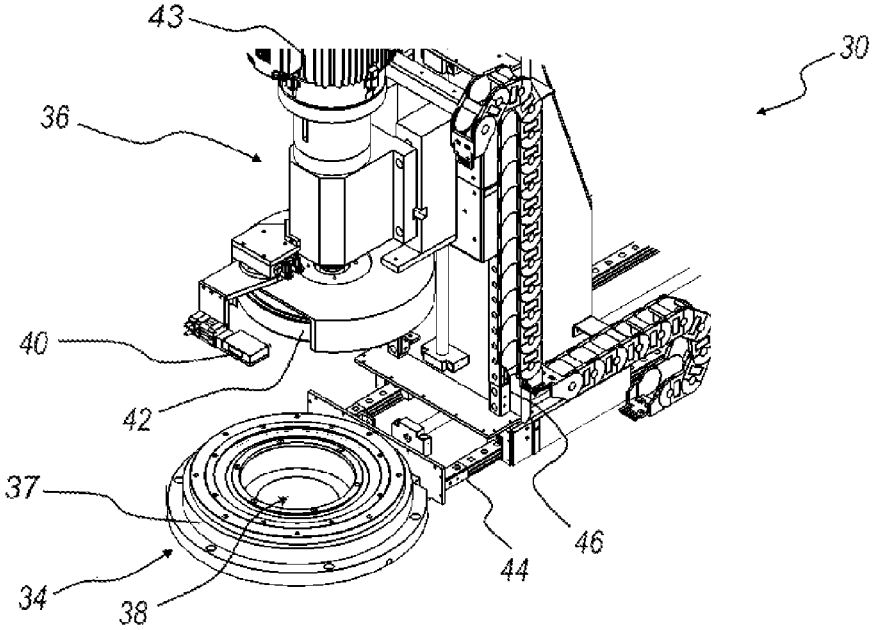
FIG. 5 is a perspective view of a portion of the exemplary apparatus illustrated in FIG. 4.

FIG. 5 is a perspective view of a portion of the exemplary tool processing apparatus 30 illustrated in FIG. 4. As shown in FIG. 5, rotational orientation portion 34 may comprise a collet 37 having an orienting recess 38 configured to hold and secure a rotary drill tool, such as drill bit 10. For example, collet 37 may be configured to securely hold and position a shank portion (e.g., shank 16 in FIG. 1) of a rotary drill tool.

As additionally shown in FIG. 5, horizontal-vertical orientation portion 36 may comprise a scanner 40, a grinding wheel 42, and a motor 43. Scanner 40 may comprise any suitable type of scanning instrument designed to identify and collect concerning various locations on the surface of a rotary drill tool mounted on rotational orientation portion 34. For example, scanner 40 may comprise a 3-dimensional scanner configured to analyze and collect data on the shape of various surface regions of a rotary drill tool. Scanner 40 may use any suitable measurement means for identifying various locations on a rotary drill tool, including, without limitation, optics, (e.g., laser or light optics), radiation (e.g., x-rays or ambient radiation), ultrasound, radio waves, and/or physical contact (e.g., using a coordinate measuring machine).

Grinding wheel 42 may comprise any suitable type and configuration of grinding wheel. In at least one embodiment, grinding wheel 42 may comprise a wheel coated and/or embedded with an abrasive compound, such as, for example, diamond and/or silicon carbide particles embedded in a bonding agent. Grinding wheel 42 may be used to remove material from exterior regions of a drill tool, such as portions of cutting elements 14 mounted on an exterior of a drill bit 10. In some embodiments, as shown in FIG. 5, grinding wheel 42 may be positioned in a substantially horizontal orientation such that grinding wheel 42 is rotational about a substantially vertical axis. Accordingly, when a rotary drill tool is mounted on collet 37 in a vertical orientation, grinding wheel 42 may readily remove material from radially outward portions of the rotary drill tool. Motor 43 may be rotationally coupled to grinding wheel 42 and may be configured to rotate grinding wheel 42.

Tool processing apparatus 30 may additionally comprise a horizontal track 44 and a vertical track 46, as illustrated in FIG. 5. Horizontal-vertical orientation portion 36 may move horizontally and/or vertically along horizontal track 44 and/or vertical track 46 with respect to a rotary drill tool mounted on tool processing apparatus 30. In at least one embodiment, scanner 40 may be rotated or otherwise configured such that it can scan in vertical, horizontal, and other suitable directions. In such embodiments, scanner 40 may also be positioned vertically above the rotary drill tool and the scanner may move horizontally above the rotary drill tool to obtain measurements of the top portion of the drill tool.

Tool processing apparatus 30 may allow determination of a rotational axis of a rotary drill tool and may enable the rotary drill tool to be modified so that outer portions of the rotary drill tool are substantially centered about the rotational axis and/or so that the rotary drill tool exhibits a specified level of eccentricity relative to the rotational axis. Additionally, tool processing apparatus 30 may log and store information obtained by scanner 40. This stored information may be available for calculations used in determining rotational axes of various rotary drill tools. This stored information may also be used to determine efficiency and/or performance of various types of grinding wheels, particularly with respect to various types, styles, and shapes of rotary drill tools.

In various embodiments, stored information obtained by scanner 40 may be used to provide quality assurance reports concerning dimensions and accuracy of various characteristics of rotary drill tools following manufacturing and/or grinding processes. The stored information may also allow down-hole cutting performance of rotary drill tools to be correlated to various dimensions of the rotary drill tools. For example, the cutting performance of rotary drill tools may be correlated to the accuracy of the tool diameters and/or centricity of the tools about the rotational axis. Such correlations may be determined by, for example, measuring and storing dimensions of the rotary drill tools and determining corresponding performance of the tools.

According to at least one embodiment, a method for optimizing drilling performance of a rotary drill tool (e.g. drill bit 10 in FIG. 2) may comprise securing a rotary drill tool to an orienting member (e.g., orienting member 23 in FIG. 2) and identifying a cutting element rotational axis (e.g. cutting element rotational axis 19 in FIG. 2) of the rotary drill tool. The method may also comprise measuring radial locations of a plurality of surface regions (e.g., first radial location 26A and second radial location 26B in FIG. 3) of the rotary drill tool relative to the cutting element rotational axis. The method may additionally comprise modifying at least one selected surface region from the plurality of measured surface regions such that the at least one selected surface region is located at a selected radial distance relative to the cutting element rotational axis.

In some embodiments, the orienting member may comprise a rotational member having an orienting rotational axis and the cutting element rotational axis of the rotary drill tool may be substantially congruent with the orienting rotational axis of the rotational member. In additional embodiments, the orienting member may comprise a stationary member having a mounting axis and the cutting element rotational axis of the rotary drill tool may be substantially congruent with the mounting axis of the stationary member.

In at least one embodiment, the selected radial distance of a first selected surface region may be substantially equal to the selected radial distance of a second selected surface region. Additionally, the at least one selected surface region may be located radially outermost relative to the cutting element rotational axis. In some embodiments, measuring the locations of the plurality of surface regions may comprise scanning the surface regions.

In various embodiments, modifying the at least one selected surface region may comprise removing material from the rotary drill tool. Removing the material from the rotary drill tool may comprise grinding at least a portion of the rotary drill tool. In at least one example, the rotary drill tool may comprise a rotary drill bit and the material may be removed from at least one cutting element mounted on the rotary drill bit. The at least one cutting element may comprise polycrystalline diamond.

In at least on embodiment, the method may further comprise identifying two or more surface regions (e.g., first radial location 26A and second radial location 26B in FIG. 3) from the plurality of measured surface regions, determining a best-fit diameter substantially intersecting the two or more identified surface regions, and determining the concentricity of the best-fit diameter relative to the cutting element rotational axis. Modifying the at least one selected surface region may comprise modifying at least one of the two or more identified surface regions such that a best-fit diameter intersecting the two or more identified surface regions is substantially the same as a target diameter relative to the cutting element rotational axis. The target diameter may be substantially centered about the cutting element rotational axis.

According to at least one embodiment, a method for optimizing drilling performance of a rotary drill tool may comprise securing a rotary drill tool to an orienting member, identifying a cutting element rotational axis of the rotary drill tool, and measuring radial locations of a plurality of surface regions of the rotary drill tool relative to the cutting element rotational axis. The method may further comprise measuring one or more performance characteristics of the rotary drill tool and correlating the radial locations of the plurality of surface regions to the performance characteristics of the rotary drill tool.

The method may also comprise data logging at least one of the radial locations of the plurality of surface regions, the location of the cutting element rotational axis relative to at least one of the plurality of surface regions, the one or more performance characteristics of the rotary drill tool, one or more dimensions of the rotary drill tool, locations of one or more cutting elements on the rotary drill tool, locations of one or more surface features of the rotary drill tool, and one or more diameter measurements of the rotary drill tool. In some examples, correlating the radial locations of the plurality of surface regions to the performance characteristics of the rotary drill tool may comprise determining drill tool performance with respect to at least one of dimensional accuracy of the rotary drill tool relative to a diameter of the rotary drill tool and dimensional accuracy of the rotary drill tool relative to the cutting element rotational axis.

According to some embodiments, a method for grinding a down-hole drill tool may comprise securing a down-hole drill tool to a holding member in a substantially vertical orientation and grinding portions of the down-hole drill tool using a grinding wheel (e.g., grinding wheel 42). Grinding portions of the down-hole drill tool may comprise grinding cutting elements mounted on the down-hole drill tool. Grinding portions of the down-hole drill tool may additionally comprise rotating the grinding wheel about a substantially vertical axis.

According to at least one embodiment, a method for optimizing grinding machine performance may comprise securing a rotary drill tool to an orienting member, identifying a cutting element rotational axis of the rotary drill tool, and measuring radial locations of a plurality of surface regions of the rotary drill tool relative to the cutting element rotational axis. The method may further comprise grinding at least one selected surface region from the plurality of measured surface regions using a grinding wheel and measuring one or more performance characteristics of the grinding wheel.

The method may further comprise correlating one or more performance characteristics of the grinding wheel to at least one of the radial locations of the plurality of surface regions, one or more characteristics of the selected surface region, and one or more characteristics of the grinding wheel.

According to various embodiments, a method for optimizing drilling performance of a rotary drill tool may comprise securing a rotary drill tool to an orienting member and identifying a rotational axis of the rotary drill tool. The rotational axis may comprise at least one of a cutting element rotational axis and a bit body rotational axis. The method may additionally comprise measuring radial locations of a plurality of surface regions of the rotary drill tool relative to the rotational axis and modifying at least one selected surface region from the plurality of measured surface regions such that the at least one selected surface region is located at a selected radial distance relative to the rotational axis.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A method for optimizing drilling performance of a rotary drill tool, the method comprising:

securing a rotary drill tool to an orienting member;

identifying a cutting element rotational axis of the rotary drill tool;

measuring radial locations of a plurality of surface regions of the rotary drill tool relative to the cutting element rotational axis;

identifying two or more surface regions from the plurality of measured surface regions;

determining a best-fit diameter substantially intersecting the two or more identified surface regions;

modifying at least one selected surface region from the plurality of measured surface regions such that the at least one selected surface region is located at a selected radial distance relative to the cutting element rotational axis, wherein modifying the at least one selected surface region comprises modifying at least one of the two or more identified surface regions such that the best-fit diameter intersecting the two or more identified surface regions is substantially the same as a target diameter relative to the cutting element rotational axis.

2. The method of claim 1, wherein:

the orienting member comprises a rotational member having an orienting rotational axis;

the cutting element rotational axis of the rotary drill tool is substantially congruent with the orienting rotational axis of the rotational member.

3. The method of claim 1, wherein:

the orienting member comprises a stationary member having a mounting axis;

the cutting element rotational axis of the rotary drill tool is substantially congruent with the mounting axis of the stationary member.

4. The method of claim 1, wherein the selected radial distance of a first selected surface region is substantially equal to the selected radial distance of a second selected surface region.

5. The method of claim 1, wherein the at least one selected surface region is located radially outermost relative to the cutting element rotational axis.

6. The method of claim 1, wherein measuring the radial locations of the plurality of surface regions comprises scanning the surface regions.

7. The method of claim 1, wherein modifying the at least one selected surface region comprises removing material from the rotary drill tool.

8. The method of claim 7, wherein removing the material from the rotary drill tool comprises grinding at least one portion of the rotary drill tool.

9. The method of claim 7, wherein:

the rotary drill tool comprises a rotary drill bit;

the material is removed from at least one cutting element mounted on the rotary drill bit.

10. The method of claim 9, wherein the at least one cutting element comprises at least one of:

a hard material;

a superhard material.

11. The method of claim 9, wherein the at least one cutting element comprises at least one of:

a polycrystalline diamond material;

a ceramic material;

a carbide material.

12. The method of claim 1, wherein the target diameter is substantially centered about the cutting element rotational axis.

13. A method for optimizing drilling performance of a rotary drill tool, the method comprising:

securing a rotary drill tool to an orienting member;

identifying a cutting element rotational axis of the rotary drill tool;

measuring radial locations of a plurality of surface regions of the rotary drill tool relative to the cutting element rotational axis;

identifying two or more surface regions from the plurality of measured surface regions;

determining a best-fit diameter substantially intersecting the two or more identified surface regions;

measuring one or more performance characteristics of the rotary drill tool;

correlating the radial locations of the plurality of surface regions to the performance characteristics of the rotary drill tool;

modifying at least one of the two or more identified surface regions such that the best-fit diameter intersecting the two or more identified surface regions is substantially the same as a target diameter relative to the cutting element rotational axis.

14. The method of claim 13, further comprising data logging at least one of:

the radial locations of the plurality of surface regions;

the location of the cutting element rotational axis relative to at least one of the plurality of surface regions;

the one or more performance characteristics of the rotary drill tool;

one or more dimensions of the rotary drill tool;

locations of one or more cutting elements on the rotary drill tool;

locations of one or more surface features of the rotary drill tool;

one or more diameter measurements of the rotary drill tool.

15. A method for optimizing grinding machine performance, the method comprising:

securing a rotary drill tool to an orienting member;

identifying a cutting element rotational axis of the rotary drill tool;

measuring radial locations of a plurality of surface regions of the rotary drill tool relative to the cutting element rotational axis;

identifying two or more surface regions from the plurality of measured surface regions;

determining a best-fit diameter substantially intersecting the two or more identified surface regions;

grinding at least one selected surface region from the plurality of measured surface regions using a grinding wheel;

measuring one or more performance characteristics of the grinding wheel;

wherein grinding the at least one selected surface region comprises grinding at least one of the two or more identified surface regions such that the best-fit diameter intersecting the two or more identified surface regions is substantially the same as a target diameter relative to the cutting element rotational axis.

16. A method for optimizing drilling performance of a rotary drill tool, the method comprising:

securing a rotary drill tool to an orienting member;

identifying a rotational axis of the rotary drill tool, the rotational axis comprising at least one of:

a cutting element rotational axis;

a bit body rotational axis;

measuring radial locations of a plurality of surface regions of the rotary drill tool relative to the rotational axis;

identifying two or more surface regions from the plurality of measured surface regions;

determining a best-fit diameter substantially intersecting the two or more identified surface regions;

modifying at least one selected surface region from the plurality of measured surface regions such that the at least one selected surface region is located at a selected radial distance relative to the rotational axis, wherein modifying the at least one selected surface region comprises modifying at least one of the two or more identified surface regions such that the best-fit diameter intersecting the two or more identified surface regions is substantially the same as a target diameter relative to the cutting element rotational axis.

* * * * *